United States Patent [19]

Merchant

[11] Patent Number: 4,806,899

[45] Date of Patent: Feb. 21, 1989

[54] THERMAL CIRCUIT BREAKER

[75] Inventor: Donald K. Merchant, Cambridge, Md.

[73] Assignee: Airpax Corporation, Cambridge, Md.

[21] Appl. No.: 39,299

[22] Filed: Apr. 20, 1987

[51] Int. Cl.[4] ..... H01H 37/10; H01H 37/52

[52] U.S. Cl. ..... 337/378; 337/70; 337/99

[58] Field of Search ..... 337/66, 70, 99, 111, 337/378, 373, 379

[56] References Cited

U.S. PATENT DOCUMENTS

| | | | |
|---|---|---|---|
| 2,150,013 | 3/1939 | Von Hoorn . | |
| 2,223,673 | 12/1940 | Catron et al. . | |
| 2,416,266 | 2/1947 | Landmeier . | |
| 2,504,513 | 4/1950 | Fleming . | |
| 2,703,662 | 3/1955 | Meyer . | |
| 3,171,929 | 3/1965 | Jencks et al. . | |
| 3,238,779 | 3/1966 | Wolfe | 337/378 |
| 3,238,780 | 3/1966 | Doyle | 337/378 |
| 3,453,408 | 7/1969 | Mune . | |
| 3,500,275 | 3/1970 | Oravec . | |
| 3,950,066 | 4/1976 | Bienwald . | |
| 4,326,183 | 4/1982 | Tharp | 337/70 |
| 4,338,586 | 7/1982 | Scanlon | 337/70 |
| 4,510,479 | 4/1985 | Merchant | 337/66 |

FOREIGN PATENT DOCUMENTS

| | | |
|---|---|---|
| 2430707 | 8/1976 | Denmark . |
| 080559 | 8/1982 | European Pat. Off. . |
| 75346 | 3/1959 | France . |

*Primary Examiner*—H. Broome

[57] ABSTRACT

An improved thermal circuit breaker is disclosed, featuring a U-shaped bimetallic element which latches an escapement locking arm which holds a spring biased moving contact against a fixed contact when the breaker is in the contacts closed position. The improved thermal element has terminal portions which are of lesser electrical resistivity than are other portions of the element. The relative orientation of the metals of the bimetallic element in the terminal portions are reversed with respect to their orientation in the remainder of the bimetallic element. In this way ambient temperature compensation is provided to the breaker such that the current rating of a given breaker does not vary with variation in ambient temperature.

39 Claims, 6 Drawing Sheets

Off Position

On Position

Trip-Free Position

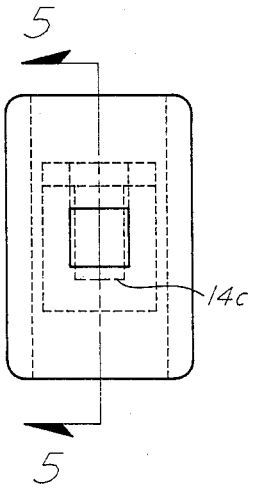
Figure 4
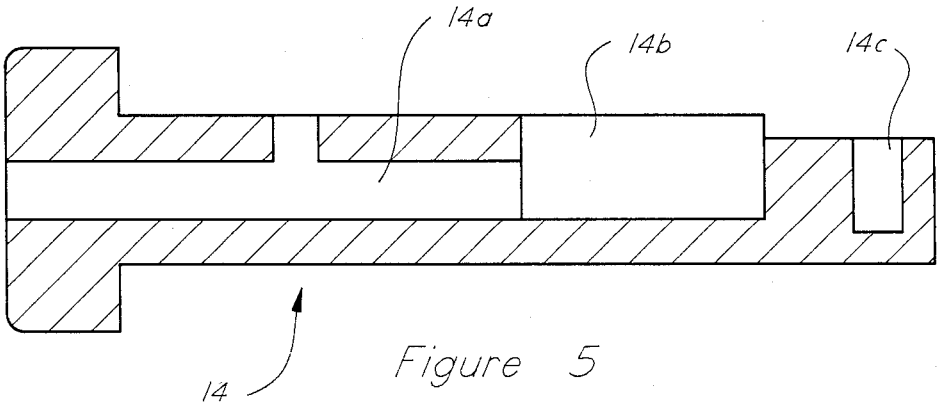
Figure 5
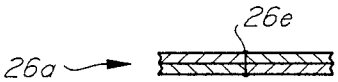
Figure 7
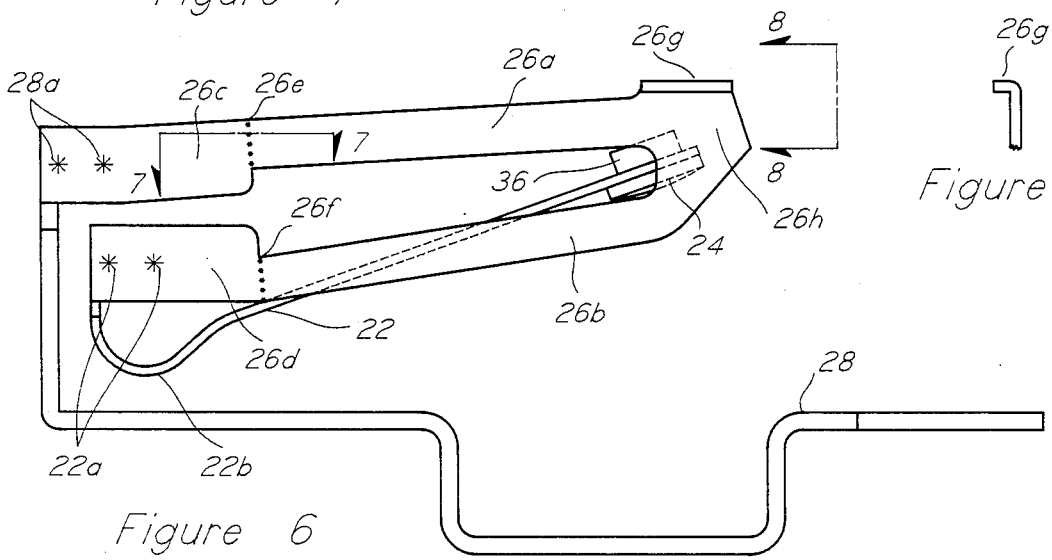
Figure 6
Figure 8

THERMAL CIRCUIT BREAKER

BACKGROUND OF THE INVENTION

1. Field of the Invention

This invention relates to thermal circuit breakers.

2. Description of the Related Art

A number of circuit breakers are known in which a bimetallic element responds to an overcurrent through the breaker by physical deformation so as to trip the breaker, interrupting the current. See, for example, U.S. Pat. No. 4,510,479, which is in the name of the present inventor and which is commonly assigned with the present application. The breaker shown in that patent has a pivoted contact arm carrying one of the contacts of the breaker. A bimetallic strip carries the other contact of the breaker. When an overcurrent passes through the bimetallic strip, it deforms urging the contact arm to move against the bias of an overcenter spring. When the bimetallic element forces the pivoted contact member past the overcenter point, the breaker snaps open, breaking the circuit.

The breaker shown in the prior patent referred to above involves a compromise relating to the spring pressure urging the contact on the moving contact arm against the contact carried by the bimetallic member. That is, since the bimetallic member must move the contact arm against the over center spring bias in order to trip the breaker, the spring force must be less than the force developed by the bimetallic member in response to an overcurrent. Where the breaker is of relatively low current rating, such that a relatively low current is required to deform the bimetallic element and trip the breaker, the spring pressure must be reduced correspondingly. In some cases, the force urging the moving contact on the contact arm against the contact carried by the bimetallic element was occasionally insufficient to provide good electric contact therebetween. Hence, a voltage drop across the contacts of the breaker was noted. For similar reasons, the breaker shown in that patent occasionally exhibited circuit interruption due to vibration; that is, vibration of the breaker would cause the pivoted contact arm to bounce away from the contact on the bimetallic member, even against the bias of the overcenter spring.

Other known thermal breaker designs have involved the latching of a spring biased contact arm carrying a movable contact by a bimetallic element, in which the end of the bimetallic element is received by a ledge or other recess on a surface of the moving contact arm. When the bimetallic element flexes due to heating (which can be due to passage of an overcurrent therethrough or due to heating of the ambient air within the breaker housing, caused by current passing through a separate heating element) the edge of the bimetallic element is pulled out of engagement with the retaining ledge, releasing the movable contact. The edge of such bimetallic elements has typically been a sharp stamped edge, often having a burr, which is received by the retaining ledge. The friction between the burr on the bimetallic element and the ledge can be quite high, such that the breaker is prevented from releasing properly. This can lead to wide variations in breaker current ratings and to improper operation.

Examples of breakers in which an edge of the bimetallic element engages a retaining ledge include Fleming U.S. Pat. No. 2,504,513, Von Hoorn U.S. Pat. No. 2,150,013, and Landmeier U.S. Pat. No. 2,146,266.

Landmeier also suggests that such a breaker structure can be provided in a 'tripfree' configuration such that an individual can not override the thermal tripping function, e.g., by holding the breaker actuating handle in the 'ON' position.

U.S. Pat. No. 4,338,586 to Scanlon shows a circuit breaker in which a pivoted latch lever has a detent for restraining movement of a slidable latch. When a bimetallic element is heated by an overcurrent therethrough, it engages the latch lever and pivots it away from the slidable latch, moving the detent out of engagement with the latch. The latch then moves, allowing a movable contact arm to pivot in response to spring bias provided by the resilient nature of the movable contact arm. The contacts then open.

In the Scanlon design, the force exerted by flexing of the bimetallic element does not have to directly overcome the bias of the movable contact arm, inasmuch as the bimetallic element controls the motion of a latch. However, the bimetallic element does not itself latch a locking member. Instead, the bimetallic element contacts the latch lever, which in turn controls the slidable latch. A multiplicity of parts is thus provided, such that it would appear very difficult to provide the Scanlon breaker in a very small package. The large number of parts in the Scanlon design would also appear to render it relatively expensive to produce.

Furthermore, the Scanlon breaker does not appear to provide ambient temperature compensation; that is, it does not in any way distinguish between deformation of the bimetallic element due to variations in ambient temperature and due to passage of an overcurrent therethrough. Accordingly, the trip point of the Scanlon breaker would naturally vary with variations in ambient temperature.

SUMMARY OF THE INVENTION

The above needs of the art are addressed by the present invention, which comprises an improved thermal breaker. The breaker according to the invention comprises a casing, line and load terminals, a contact arm carrying a movable contact, a fixed contact, and a U-shaped bimetallic element, in which the plane of lamination is parallel to the plane of the U, connected between the contact arm and load terminal. Ambient temperature compensation is provided, while the bimetallic element latches an escapement locking arm which controls the contact arm.

More particularly, the bimetallic element is U-shaped, having legs joined by a bright portion. The ends of the legs are confined and are of greater width than the remaining portions of the legs which are joined to the bight portion, which is free. The bight portion latches the escapement locking arm. The relative orientation of the metals of the bimetallic element is reversed at the point where the wider confined ends of the legs meet the narrower remaining portions. The deformation of the element caused by variation in ambient temperature thus occurs in opposite directions in the confined and free portions of the legs; no net deflection of the bight occurs. When an overcurrent passes through the element, however, the wider portions, being of lesser resistivity than the narrower portions, are heated correspondingly less. Therefore an overcurrent results in net deflection of the bight, and tripping of the breaker.

BRIEF DESCRIPTION OF THE DRAWINGS

The invention will be better understood if reference is made to the accompanying drawings, in which:

FIG. 4 shows an end view of the actuating handle of the breaker of the invention;

FIG. 5 shows a cross-sectional view taken along the line 5—5 of FIG. 4;

FIG. 6 shows a side elevational view of the bimetallic element, moving contact arm, and line terminal assembly of the breaker of the invention;

FIG. 7 shows a partial cross-sectional view taken along the line 7—7 of FIG. 6; and FIG. 8 shows an end view taken generally along the line 8—8 of FIG. 6.

FIG. 9(*a*) shows the bending undergone by a U-shaped element in which the metals are of uniform orientation; FIG. 9(*b*) shows the bending of a version in which the orientation of the materials of the bimetallic sheet varies along the length of the legs of the U; and FIG. 9(*c*) shows the bending of an element in which the orientation of the material of the bimetallic sheet varies along the legs of the U, and in which the transverse width of the legs of the U changes generally at the point along the legs where the relative orientation varies.

DESCRIPTION OF THE PREFERRED EMBODIMENTS

Figure 1:
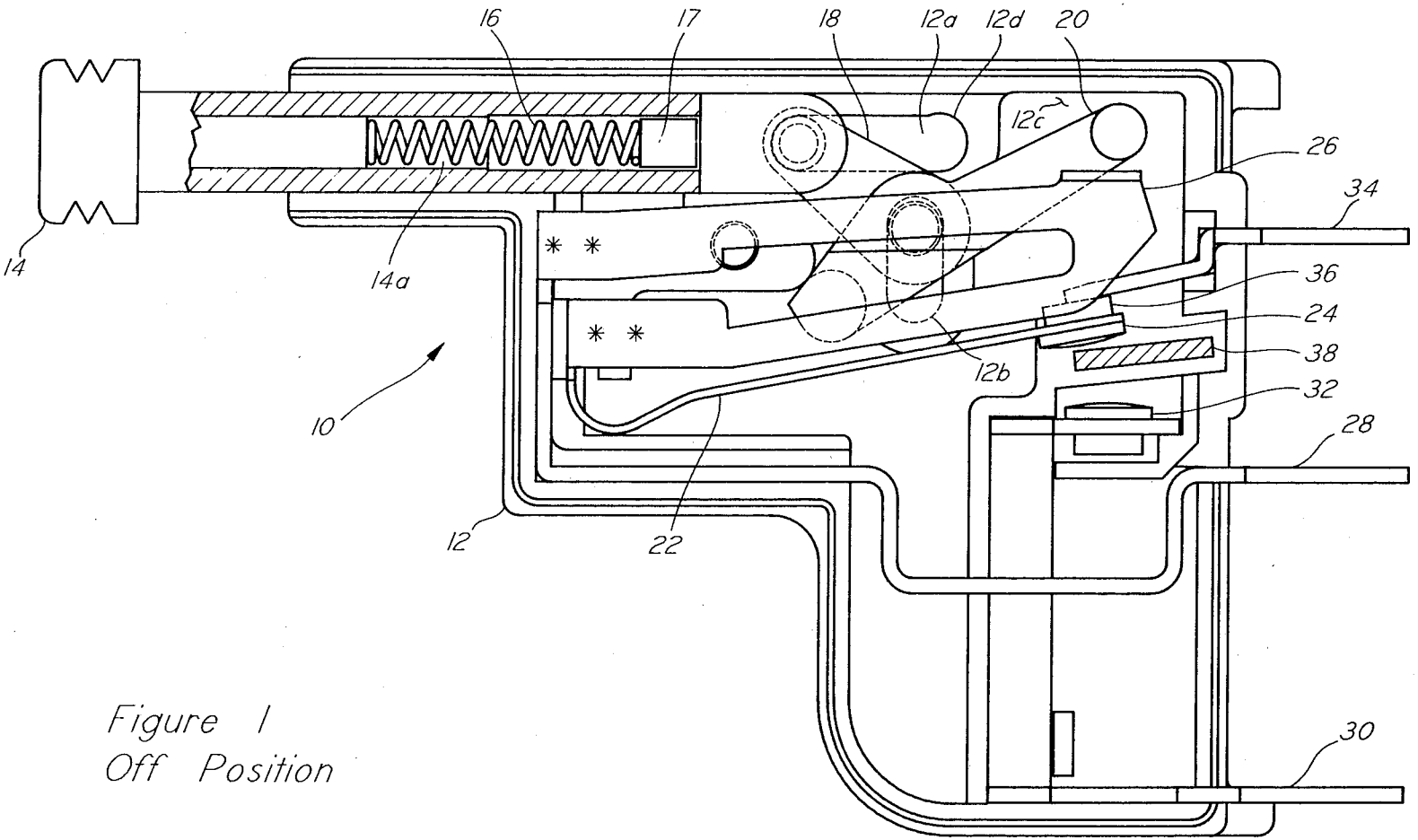
FIG. 1 shows an overall view of the breaker of the invention, in the contacts-open or OFF position, in which it is ready to be reset.

As mentioned above, the breaker of the invention comprises a casing, line and load terminals, a fixed contact, a movable contact carried by a contact arm, a bimetallic element, and a escapement locking arm. The bimetallic element latches the escapement locking arm, which in turn controls the movement of the contact arm.

The U-shaped bimetallic element of the breaker according to the invention comprises two elongated legs connected by a bight. The bight of the bimetallic element interacts with a locking surface on the escapement locking arm with holds the breaker in its contacts-closed or ON position. The line terminal and the movable contact of the breaker are connected to confined terminal portions of the legs of the element. The terminal portions are wider than the free leg portions of the element, which are connected by the bight. The orientation of the bimetallic materials of the legs is varied between their free and confined portions.

The reversal of the orientation of the materials of the legs provides ambient temperature compensation as folows. A rise in ambient temperature causes the confined portions of the legs of the U-shaped thermal element to deform in a first direction, while the reverseoriented free portions of the legs, which connect the confined portions to the bight of the U, deform in the other direction. No net deflection is experienced by the bight portion. Therefore, the breaker trip rating is not affected by ambient temperature variations.

By comparison, when an overcurrent passes through the U-shaped thermal element, the wider confined portions of the legs of the U, being of greater electrical conductivity than the narrower leg portions, are accordingly heated by the overcurrent to a lesser extent than are the narrower free portions. Therefore, the free portions deform more than do the confined portions. Accordingly, even though the relative deformation of the differing portions of the legs caused by an overcurrent is reversed due to the reversal of the relative orientation of the bimetallic materials, a net deflection of the bight portion occurs. Thus provision of ambient temperature compensation does not prevent the thermal element from deforming and providing protection upon passage of an overcurrent therethrough.

The bimetallic element performs a latching function, that is, it latches a locking member in the contacts-closed or ON position in which a first movable contact carried by a contact arm is urged into a second fixed contact. Accordingly, deformation of the bimetallic element does not take place against the bias of a spring urging the movable contact against the fixed contact. This allows the moving contact to be biased into the fixed contact with a force sufficient to ensure good electrical contact therebetween, ensuring reliable operation of the breaker of the invention.

In a particularly preferred embodiment, the bimetallic element comprises a flat-surfaced latching lip member formed by folding over a tab on the sheetlike bimetallic element. The latching lip interacts with a locking surface on a locking arm of the breaker assembly. The relatively wide surfaces of the latching lip and locking surface cooperate to ensure relatively low friction therebetween. Accordingly, when an overcurrent occurs, the thermal element is permitted to slide relatively freely out of engagement with the latching member. This allows breakers according to the invention, even of relatively low current rating, to conform accurately to their current ratings.

Figure 2:
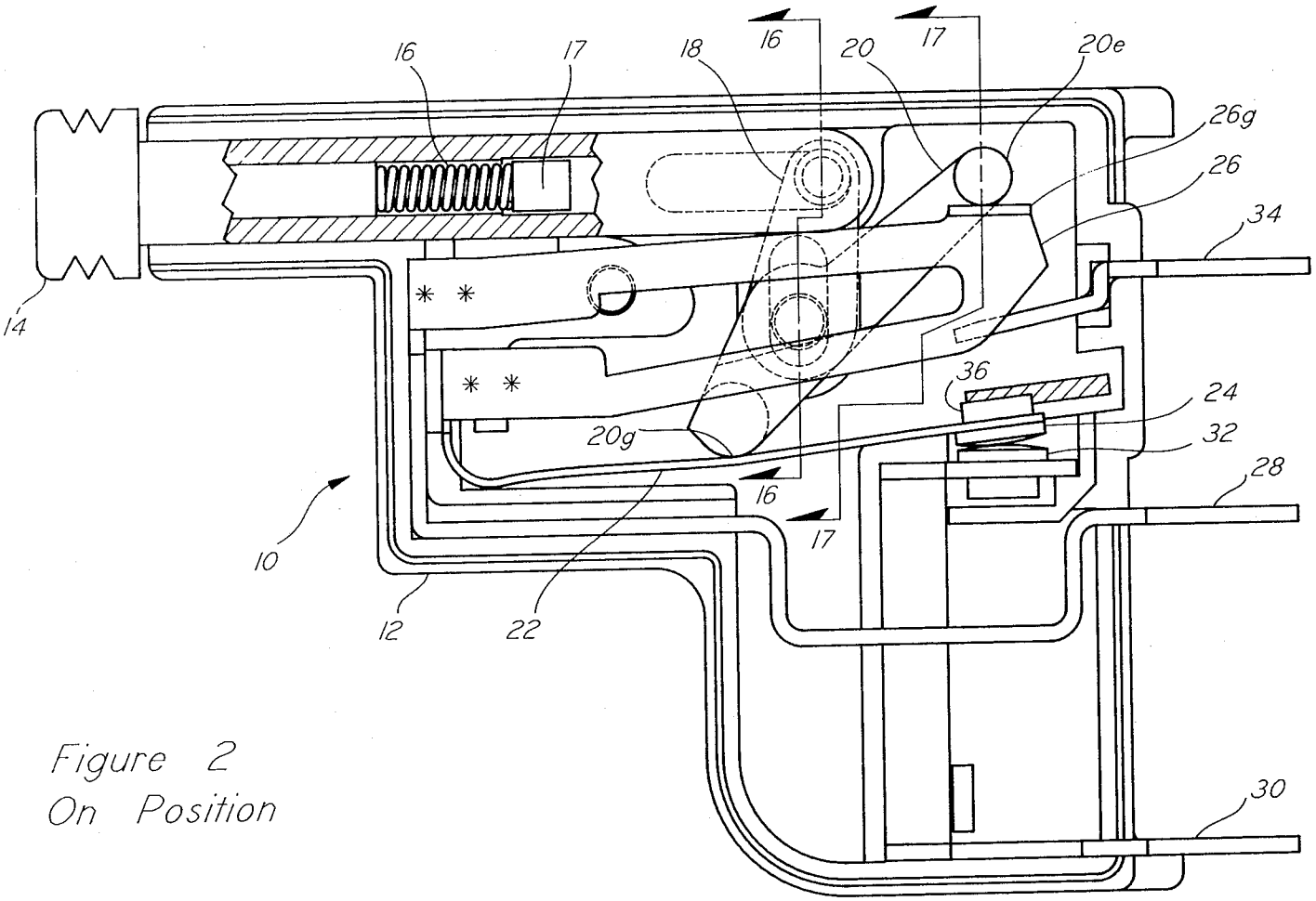
FIG. 2 shows a view corresponding to that of FIG. 1 with the breaker in the contacts-closed or ON position, having been reset.
Figure 3:
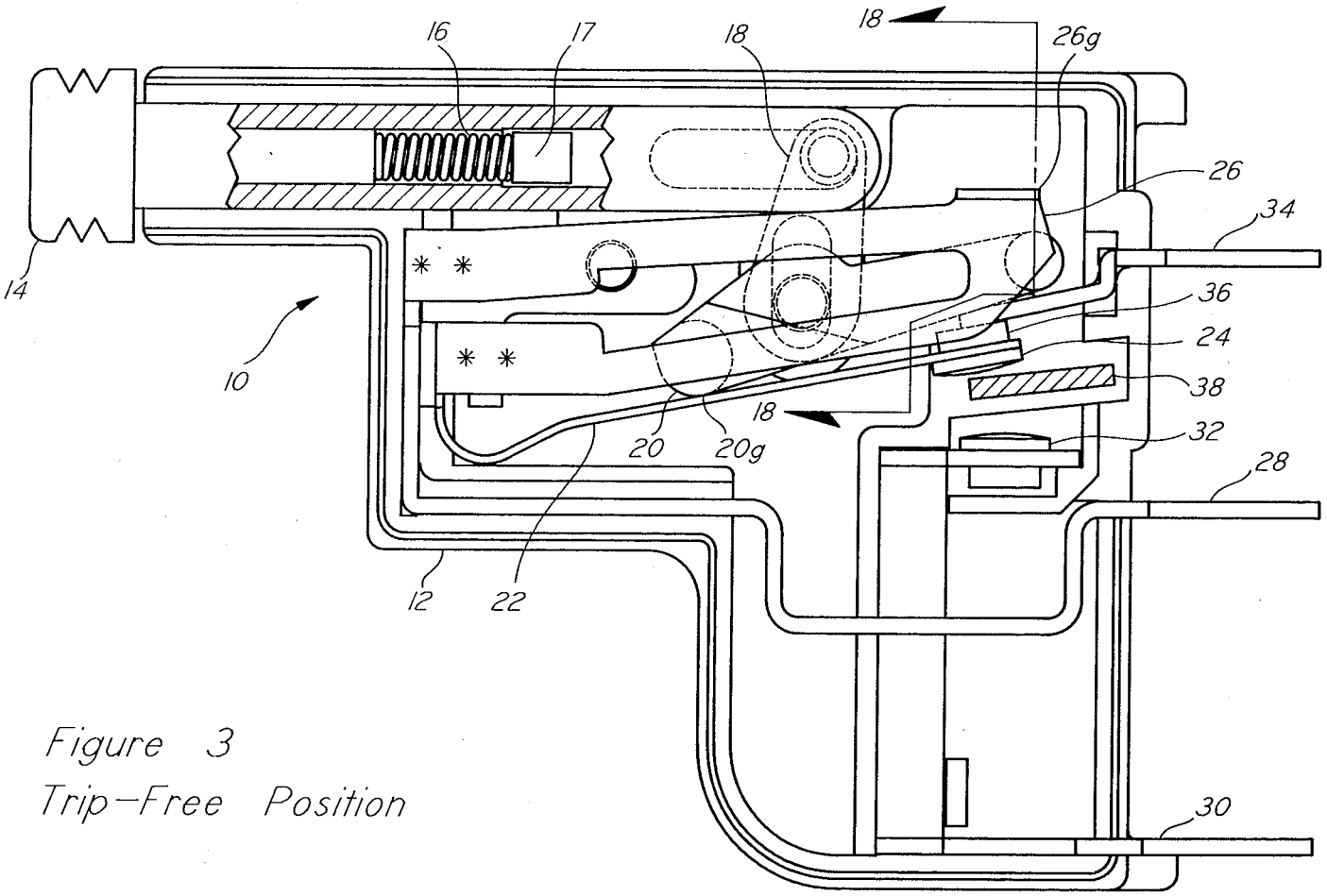
FIG. 3 shows a view corresponding to that of FIG. 1 with the breaker of the invention in the trip-free position, in which it cannot be reset.
Figure 15:
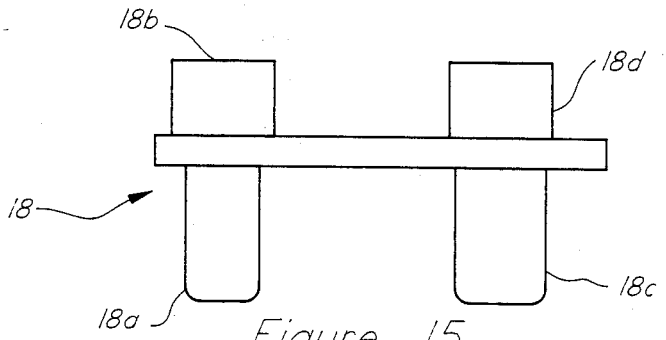
FIG. 15 shows an elevational view of the handle link of FIG. 14.
Figure 14:
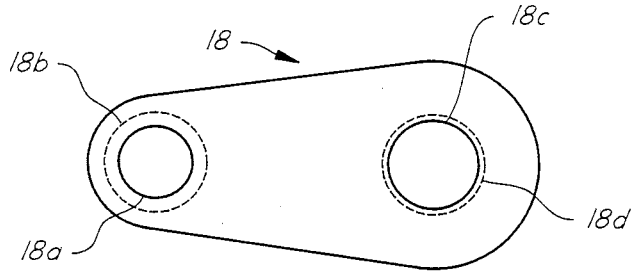
FIG. 14 shows a plan view of the handle link of the breaker according to the invention.
Figure 16:
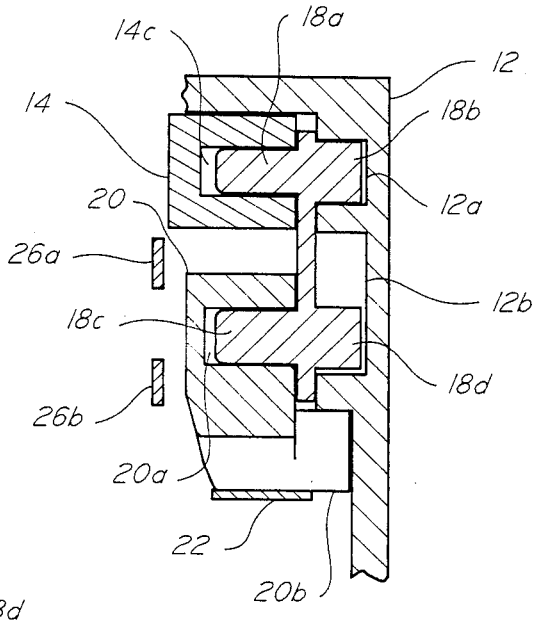
FIG. 16 shows a partial cross-sectional view taken along the line 16—16 of FIG. 2.
Figure 17:
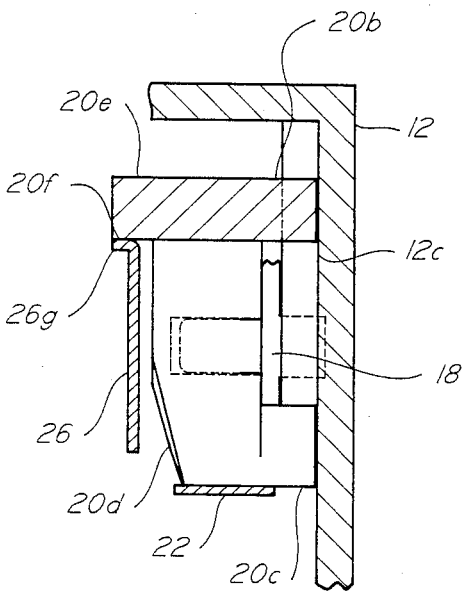
FIG. 17 shows a partial cross-sectional view taken along the line 17—17 of FIG. 2.
Figure 18:
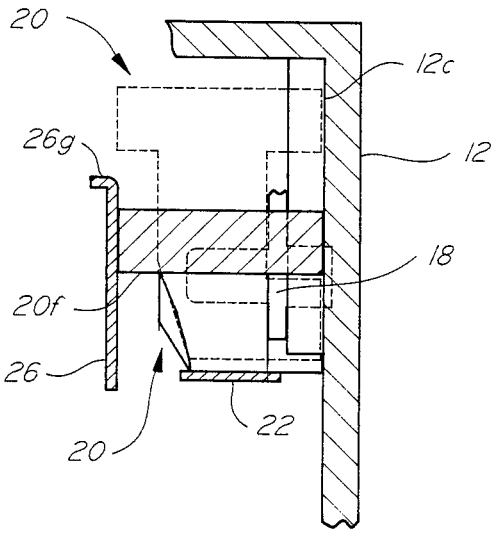
FIG. 18 shows a partial cross-sectional view taken along the line 18—18 of FIG. 3, and additionally shows in phantom the position of the escapement locking arm in the "OFF" position of FIG. 1.

In the description of the preferred embodiments which follows, FIGS. 1, 2 and 3 are assembly drawings of the breaker of the invention in the contacts-open or OFF, contacts-closed or ON, and trip-free positions, respectively. The breaker of the invention comprises several main parts, shown in detail in other groups of the Figures. Thus, FIGS. 4 and 5 detail the handle; FIGS. 6–8 detail the bimetallic element and illustrate its method of operation; FIGS. 10–13 detail the escapement locking member; and FIGS. 14 and 15 show the handle link. Finally, FIGS. 16–18 show partly cross-sectional, partly elevational views of some of the parts of the breaker of the invention in its differing positions. Accordingly, reference should be made simultaneously to the appropriate Figures for a clear understanding of the principles of the invention.

As shown in FIG. 1, the breaker, generally designated 10, comprises a casing 12 from which protrudes an actuating handle 14. Handle 14 is detailed in FIGS. 4 and 5. The actuating handle 14 is biased out of the casing 12 by a spring 16 which fits within a recess 14*a* in the actuating handle and abuts a post 17 which is received in corresponding recesses in the casing. The handle 14 is connected by a handle link 18, detailed in FIG. 14 and 15, to an escapement locking arm 20, detailed in FIGS. 10–13.

The escapement locking arm 20 is formed to comprise a bearing surface 20*g* which bears against a resilient contact arm 22. The contact arm 22 carries a movable contact 24; when the breaker 10 is in the contacts-closed or ON position shown in FIG. 2, the movable contact 24 abuts a stationary contact 32. The stationary contact 32 is fixed to a load terminal 30. The movable contact 24 is connected by way of the contact arm 22 and the bimetallic element 26 to a line terminal 28. When the breaker 10 is in the OFF position, shown in FIG. 1, or the trip-free position shown in FIG. 3, a fault contact 36 carried together with the movable contact 24 abuts a fault terminal 34 which can be used to provide an indication that the breaker is in the OFF or trip-free position.

As can be seen in FIGS. 14 and 15, the handle link 18 comprises a generally planar central section and two pins 18*a* and 18*c* which are generally concentric with two posts 18*b* and 18*d*, respectively. As shown in FIG. 16, posts 18*b* and 18*d* fit into recesses 12*a* and 12*b* in the casing 12, while pins 18*a* and 18*c* fit into recesses 14*c* and 20*a* in the handle 14 and escapement locking arm 20, respectively.

As can be observed from a comparison of FIGS. 1, 2 and 3, the relative configuration of the recesses 12*a* and 12*b* are such that when the handle 14 is pressed by a user and moves from its OFF position shown in FIG. 1 to the ON position shown in FIG. 2, the pin 18*a* by which the handle link 18 is connected to the handle 14 is moved rightwardly. This motion forces the post 18*d* downwardly in its corresponding recess 12*b*. This motion exerts a downward force on the center of escapement locking arm 20, that is, through pin 18*c*. The rightward end of escapement locking arm 20 (as shown in FIGS. 1–3) is latched against downward motion by bimetallic element 26, in a manner discussed below. Accordingly, the downward motion of pin 18*d* causes the escapement locking arm 20 to be pivoted generally counter-clockwise. This causes its bearing surface 20*g* to bear against the contact arm 22, forcing movable contact 24 downwardly against the spring bias provided by the contact arm 22, which is of a resilient material. When the movable contact 24 abuts the fixed contact 32 it is held firmly thereagainst by the flexing of the resilient contact arm 22.

As shown in FIG. 17, the escapement locking arm 20 comprises an upper bearing member 20*b* which buts against an inner rear wall 12*c* of the casing 12. A locking arm 20*e* is opposed to the upper bearing member 20*b*. A locking surface 20*f* is formed on arm 20*c* of the escapement locking arm. Locking surface 20*f* interacts with a latching lip 26*g* formed on the bimetallic element 26, again as shown in FIG. 17. In the contacts-closed or ON position, the bimetallic element 26 prevents the end of the escapement locking arm 20 carrying the latching surface 20*f* from moving downwardly from its position shown in FIG. 2.

When an overcurrent passes through the bimetallic element 26, it bends (that is, out of the plane of the paper and toward the viewer in FIGS. 1–3), taking the position shown in FIG. 18. When this occurs, the latching lip 26*g* moves past the locking surface 20*f*, that is, moves leftwardly with respect to its position in FIG. 17. This allows the end of the escapement locking arm 20 carrying the locking surface 20*f* to move downwardly from its position in FIG. 2. This in turn allows the other end of escapement locking arm 20, which carries bearing surface 20*g*, to move upwardly; in effect, the escapement locking arm pivots about the pin 18*c*. When bearing surface 20*g* thus moves upwardly, the contact arm 22 is released. The spring bias of contact arm 22 allows the movable contact 24 to move rapidly away from the fixed contact, thus opening the breaker.

As indicated in FIG. 3, the handle 14 is not urged out of the casing when the breaker trips. This prevents an operator from overriding the tripping function by holding handle 14 down. The breaker is thus trip-free.

As shown in FIG. 18, when the bimetallic element 22 bends and the end of the escapement locking arm 20 which is latched thereby moves downwardly, the end of the escapement locking arm 20 is behind the bimetallic element 26. Until the latching lip 26*g* of the bimetallic element 26 is once again disposed beneath the locking surface 20*f* of the escapement locking arm 20, the breaker cannot be reset. Therefore, until the bimetallic element 26 has cooled, allowing the latching lip 26*g* to be disposed beneath the locking surface 20*f*, the breaker cannot be reset to the ON position, even if the user repeatedly withdraws and pushes handle 14 down.

As can be seen in FIG. 1, the recess 12*a* in housing 12 comprises a locking pocket 12*d*, into which post 18*b* of handle link 18 fits. When the breaker is in the ON position of FIG. 2, post 18*b* is biased into locking pocket 12*d* by the bias of contact arm 22, exerted via the escapement locking arm 20. This retains the handle 14 in the position shown in FIG. 2 (i.e., largely within the casing 12) when the breaker is in the ON position.

As can be seen from FIG. 6, the bimetallic element 26 is generally of U shape comprising a pair of legs 26*a* and 26*b* joined by a bight portion 26*h*. Legs 26*a* and 26*b* comprise terminal portions 26*c* and 26*d*, by which the bimetallic element 26 is joined to the line terminal 28 and the contact arm 22 by spot welds 28*a* and 22*a*, respectively. The terminal portions are wider than the remaining portions of the legs, as shown. In the preferred embodiment, the relative orientation of the metals of the bimetallic element in the terminal portions 26*c* and 26*d* is reversed with respect to the remaining portions of the legs. This has the effect of providing temperature compensation to the bimetallic element, as will be discussed in connection with FIG. 9 below. The upper terminal portion 26*c* is joined to the remaining portion of the leg 26*a* at a butt weld 26*e*; similarly, the lower terminal portion 26*d* is joined to the other leg portion 26*b* at a second butt weld 26*f*. (As will be appreciated by those of skill in the art, rather than to weld terminal portions 26c and 26d onto the remaining portions of legs 26a and 26b, normally it will be preferable to butt weld a strip of bimetallic material to a sheet of bimetallic material of reverse orientation and then stamp the element 26 from the composite sheet thus formed.)

As shown in FIG. 8, latching lip 26g simply comprises a bent-over tab formed on the upper edge of the bimetallic element 26. The purpose of forming the latching lip 26g in this fashion is to provide a relatively smooth surface (as compared to the typically relatively sharp stamped edge portion of the remainder of the bimetallic element 26) to bear against the bearing surface 20g of the escapement locking arm 20. The relatively smooth surface of latching lip 26g minimizes the friction between the latching lip 26g and the locking surface 20f of the escapement locking arm 20. This facilitates their disengagement upon passage of an overcurrent through the bimetallic element 26, which tends to minimize variation in trip current from breaker to breaker; that is, it improves the predeictability of the actual trip current.

It will have been appreciated by those of skill in the art that in the structure shown, the bimetallic element 26 does not itself hold the movable contact 24 against the fixed contact 32, that is, does not itself restrain the movable contact 24 against the bias provided by the contact arm 22. Instead, the escapement locking arm 20 provides this function, so that the bimetallic element 26 itself need merely latch the escapement locking arm 20 in position. This in turn means that an overcurrent through the bimetallic element need not cause it to deform with a force sufficient to overcome such a bias, e.g., an overcenter spring force as shown in U.S. Pat. No. 4,510,479.

More particularly, the fact that the escapement locking arm 20 and not the bimetallic element 26 holds the movable contact 24 in place against the bias provided by the contact arm 22 means that an overcurrent through the bimetallic element 26 need not create a force equal and opposite to the force required to hold the movable contact 24 firmly against the fixed contact 32. Instead, according to the invention, the force exerted by the deformation of the bimetallic element 26 need merely be sufficient to move the latching lip 26g out from underneath the locking surface 20f of the escapement locking arm 20. According to the invention, this force is further minimized because the folded-over, relatively smooth latching lip 26g engages the locking surface 20f with low friction. Sufficient force can readily be provided by a bimetallic element 26 that deforms upon passage of a relatively low amount of current therethrough. This enables the breaker of the invention to be useful in relatively low-current applications.

It will be noted further that the latching lip 26g and the terminal portions 26c and 26d of the element 26 are disposed in a triangular configuration and lie in a plane. This allows the lip 26g to withstand the force exerted on it in the ON position by escapement locking arm 20 even when the element 26 is formed of relatively thin material.

In the preferred embodiment, the spacing of the line terminals, the load terminal, and the fault terminal are such as to match common printed circuit board hole spacings, such that the breaker can be conveniently used within modern electronic equipment. This necessitates that the mechanism be relatively small and comprise a minimum number of elements. In this application, the bimetallic element must also deform in response to a relatively small overcurrent, since these devices generally do not employ high currents.

The breaker of the present invention meets these goals. As noted, the fact that the escapement locking arm 20, not the bimetallic element 26, urges the movable contact 24 against the fixed contact 32 against the bias of the contact arm 22 allows use of a bimetallic element 26 which deforms upon passage of a relatively small curent therethrough. Finally, it will be appreciated by those skilled in the art that the mechanism of the breaker of the invention is relatively simple and can be manufactured relatively easily.

As described above, the breaker of the invention comprises a contact arm 22, which holds a spring biased moving contact against a fixed contact when the breaker is in the contacts-closed position. The movement of the contact arm is controlled by the escapement locking arm 20, which is latched by the thermal element 26. According to an important aspect of the present invention, the improved thermal element 26 has terminal portions which are of lesser electrical resistivity than are other portions of the element and in which the relative orientation of the metals of the bimetallic element are reversed with respect to the remainder of the bimetallic element. In this way, ambient temperature compensation is provided to the breaker such that its rating does not vary with variation in ambient temperature.

Figure 9A:
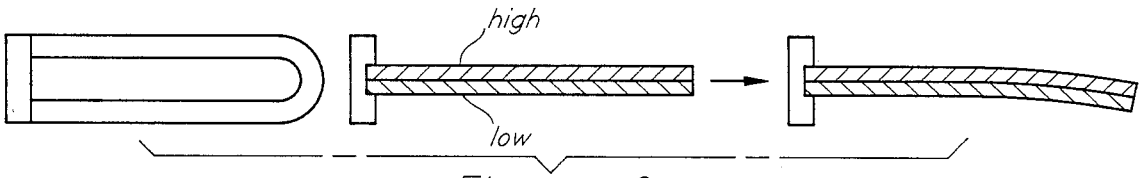
FIG. 9 comprises FIGS. 9*a* through 9*c*, which show respectively the different bending modes undergone by U-shaped bimetallic elements upon heating. Each of FIGS. 9*a*–9*c* shows a plan view of a thermal element, and side views of the configuration of the element when cool and when heated.
Figure 9B:
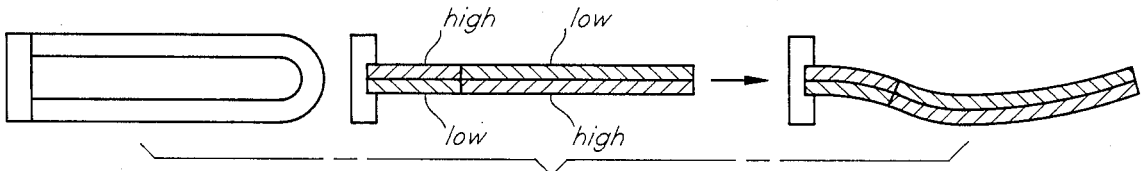
Figure 9C:
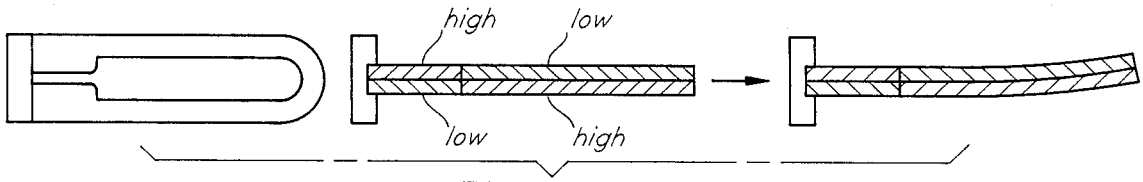
Figure 13:
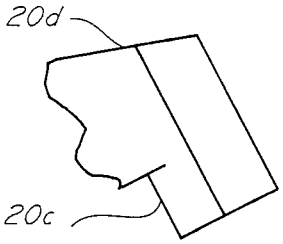
FIG. 13 shows a partial end view of the escapement locking arm of FIG. 10.
Figure 12:
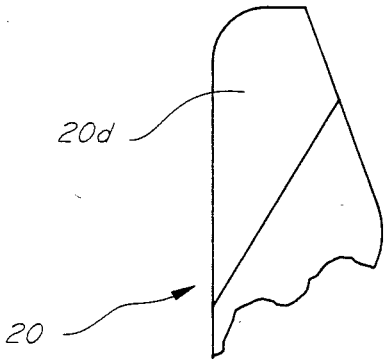
FIG. 12 shows a partial view of the other side of the escapement locking arm of FIG. 10.
Figure 11:
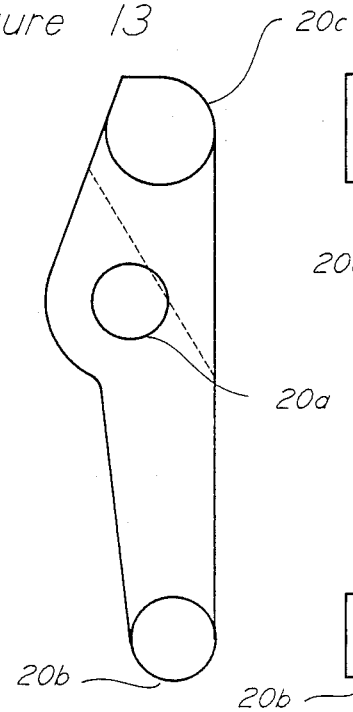
FIG. 11 shows a side view of the escapement locking arm of FIG. 10.
Figure 10:
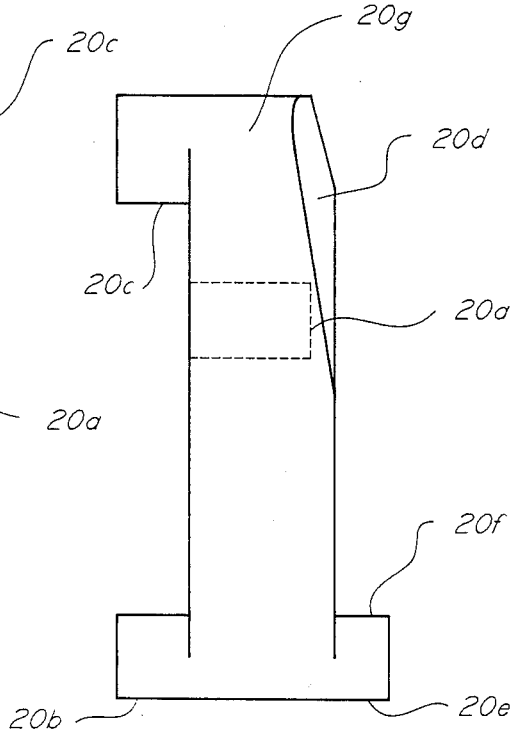
FIG. 10 shows an elevation view of the escapement locking arm.

FIG. 9 comprises FIGS. 9a–9c, which together illustrate the operation of the bimetallic element 26 according to the invention. In each case, the left diagram is a plan view of a thermal element; the center and right diagrams are side views of the element when cool and when heated.

FIG. 9a ilustrates a simple U-shaped bimetallic element, in which the U lies in the plane of the junction between the two metals of the bimetallic element. If the two ends of the U are confined, as indicated in the central diagram of FIG. 9a, and if the metal with a higher coefficient of expansion is on the upper side, the element will bend downwardly upon heating, as indicated in the right diagram of FIG. 9a.

By comparison, when a U-shaped element in which the U is perpendicular to the junction between the metals is heated, its legs simply draw together or spread apart, depending on the orientation of the materials in the strip. Such an element is shown in U.S. Pat. No. 4,338,586 to Scanlon, which is discussed above; see also Tharp U.S. Pat. No. 4,326,183.

FIG. 9b also shows a U-shaped bimetallic element. In this case the relative orientation of the metals of the element in the terminal portions of the element is reversed with respect to their orientation in the remainder of the element, as indicated at the central diagram of FIG. 9b. If this element is heated, it will bend into an S-shape as shown by the right diagram of FIG. 9b. That is, the reversal of the orientation of the metals of the bimetallic strip causes it to take a reverse bend upon heating. In this way, while the overall length of the element may be shortened slightly in response to a variation in temperature, the end of the element will not be displaced substantially from its cool position. This feature is incorporated into the bimetallic element of the breaker of the invention in its preferred embodiment. However, the bimetallic element shown in FIG. 9b deforms identically in response to variations in ambient temperature or variations in temperature due to passage of an overcurrent through its, such that the trip point of a breaker using such an element would necessarily vary to some degree with ambient temperature.

FIG. 9*c* shows a bimetallic element according to the invention, which provides ambient temperature compensation and by which variations in ambient temperature and overcurrent through the element are effectively differentiated. In this case, the relative orientation of the metals of the bimetallic strip in the terminal portions of the legs of the breaker, by which it is fixed, are again reversed with respect to the remaining portions of the element. However, the terminal portions are also wider than are the remaining free portions of the legs of the element. Therefore, the terminal portions are of lesser electrical resistance than are the remaining portions of the legs. When a current is passed through the bimetallic element, the narrower free portions of the legs will therefore be heated and bend to a greater degree than the fixed, wider portions of the legs.

Any bending of the wider portions due to an overcurrent which occurs will be in the reverse direction than the bending of the narrower portions, but will be of lesser extent. Accordingly, a net deflection of the free end of the element will occur, as shown in the right diagram of FIG. 9*c*, tripping the breaker. That is, the wider fixed and narrower free portions of the element experience a differential deflection upon heating by passage of a current therethrough. Thus, while bending of the element due to an overcurrent therethrough is exhibited primarily by the narrower portions of the legs, this is adequate to provide proper operation of the breaker of the invention. By comparison, a rise in ambient temperature will affect all portions of the legs equally; in this case, the element of FIG. 9*c* will take the position shown in the right diagram of FIG. 9*b*. Accordingly, ambient temperature compensation is provided as discussed in connection with FIG. 9*b*.

Other details shown in the drawings illustrate additional aspects of the construction of the breaker of the invention. For example, FIGS. 10, 11, 12 and 13 illustrate a cut away surface 20*d* on the side of the escapement locking arm which faces the bimetallic element, to insure that the escapement locking arm 20 slides smoothly past the bimetallic element 26 in its motion from the OFF position of FIG. 1 to the ON position of FIG. 2; that is, provision of the cutaway surface 20*d* helps to insure that the bimetallic element 26 does not snag the escapement locking arm 20 in resetting of the breaker.

FIG. 18 shows in phanthom the position of the escapement locking arm 20 when the breaker is in the OFF position shown in FIG. 1; by comparison, when the escapement locking arm 20 is released by bending of the bimetallic element 26, it takes the position shown in full in FIG. 18, that is, the trip-free position, all as discussed above.

An arc baffle 38 is shown in FIG. 1. As will be understood by those of skill in the art, arc baffles are sometimes employed in circuit breakers. These may typically comprise one or more U-shaped metallic members extending around the region through which the movable contact 24 passes when the breaker trips, to help to absorb the energy of the arc. In experimentation with the device according to the invention in a relatively low current version sized for circuit board mounting as discussed above, the applicant has found that a single arc baffle 38 is not effective. No arc baffles are expected to be employed in commercial production of these units.

It will thus be appreciated that an improved thermal circuit breaker has been described, in which ambient temperature compensation is provided and in which the force developed by the thermal element upon passage of an overcurrent therethrough is not required to exceed the bias force holding the movable and fixed contacts together. This allows the breaker to operate reliably, while a force adequate to insure good contact between the contacts is exerted when the breaker is in the ON or contacts closed position.

While a preferred embodiment of the invention has been shown and described, this should not be taken as a limitation of its scope, but merely as exemplary thereof. The invention is to be limited only by the following claims.

I claim:

1. A thermal circuit breaker, comprising:

a casing;

line and load terminals mounted in said casing;

fixed and movable contacts connected to said load and line terminals;

a contact arm carrying said movable contact for movement between contacts open and contacts closed positions; and a temperature compensated bimetallic element electrically coupled between said movable contact and one of said terminals, and adapted to control the movement of said movable contact arm in response to an electrical current flowing through said element, wherein the control provided by said element is substantially unaffected by variations in ambient temperature;

wherein said bimetallic element is formed of a generally planar sheet of laminated bimetallic material, and is generally of U-shape comprising two legs and a bight portion connecting said legs, the relative orientation of the bimetallic material of the legs of said element changing along their length, to substantially compensate for flexure of said legs due to variations in ambient temperature.

2. A thermal circuit breaker, comprising:

a casing;

line and load terminals mounted in said casing;

fixed and movable contacts connected to said load and line terminals;

a contact arm carrying said movable contact for movement between contacts open and contacts closed positions; and a temperature compensated bimetallic element electrically couple between said movable contact and one of said terminals, and adapted to control the movement of said movable contact arm in response to an electrical current flowing through said element, wherein the control provided by said element is substantially unaffected by variations in ambient temperature;

wherein said bimetallic element is formed of a generally planar sheet of laminated bimetallic material, and is generally of U-shape comprising two legs and a bight portion connecting said legs, the relative orientation of the bimetallic material of the legs of said element changing along their length, to substantially compensate for flexure of said legs due to variations in ambient temperature;

wherein said legs of said U-shaped bimetallic element comprise terminal portions by which said element is connected to said movable contact arm and to said one of said terminals, said terminal portions being of differing transverse dimensions than are their remaining portions, to provide differential deflection of said terminal and remaining portions of said legs upon passage of an electrical current through said element.

3. The breaker of claim 2, wherein said terminal portions of the legs of the element are wider than the remaining portions.

4. The breaker of claim 3, wherein said terminal portions of said legs meet said remaining portions essentially at the point along said legs at which the relative orientation of the bimetallic material thereof changes.

5. The breaker of claim 4, wherein the terminal portions of the legs of said U-shaped element are fixed and the remaining and bight portions of the element are free for controlling said movable contact arm.

6. The breaker of claim 5, further comprising an escapement locking arm for controlling said movable contact arm.

7. The breaker of claim 6, wherein said movable contact arm is biased so as to break contact between said fixed and movable contacts, and said bimetallic element is adapted to latch said escapement locking arm such that said escapement locking arm holds said movable contact arm in a contacts closed position, in which said contacts are held closed against said bias.

8. The breaker of claim 7, wherein said escapement locking arm has formed thereon a locking surface located such that a latching lip of said element engages said locking surface to latch said escapement locking arm in the contacts closed position upon resetting of said breaker.

9. The breaker of claim 8, wherein said escapement locking arm is mounted for movement between a contacts closed position, in which it locks said movable contact arm, and a tripped position, said movable contact arm normally being biased against said locking arm to move said locking arm between the contacts closed and tripped positions upon tripping of said breaker.

10. The breaker of claim 2, wherein upon being tripped said breaker takes a trip-free configuration.

11. The breaker of claim 2, wherein said breaker is adapted to be mounted on a printed circuit board.

12. A circuit breaker, comprising:

a casing;

line and load terminals;

a contact arm;

fixed and movable contacts, said fixed contact being mounted in said casing and connected to one of said terminals, and said movable contact being carried by said contact arm;

a bimetallic control element, adapted for latching said contact arm in a contact closed position such that said movable contact abuts said fixed contact, said control element being electrically coupled between the other said terminals and said movable contact, said bimetallic control element being generally of U-shape, comprising two legs joined by a bight portion, said legs defining first free portions and second fixed portions wherein the relative orientation of the materials of a said bimetallic element varies with respect to said first and second portions of said legs;

said first free portions being of substantially greater electrical resistance than the second fixed portions, said first free portions being joined by the bight of said element, such that upon passage of an overcurrent through said bimetallic element it bends primarly in the first free portions, whereby said movable contact arm is released.

13. The breaker of claim 12 further comprising an actuating handle connected by linkage means to said contact arm for resetting the breaker after tripping.

14. A circuit breaker, comprising:

a casing;

line and load terminals;

a contact arm;

fixed and movable contacts, said fixed contact being mounted in said casing and connected to one of said terminals, and said movable contact being carried by said contact arm;

a bimetallic control element, adapted for latching said contact arm in a contact closed position such that said movable contact abuts said fixed contact, said control element being electrically coupled between the other said terminals and said movable contact, said bimetallic control element being generally of U-shape, comprising two legs joined by a bight portion, said legs defining first free portions and second fixed portions wherein the relative orientation of the materials of a said bimetallic element varies with respect to said first and second portions of said legs;

said first free portions being substantially greater electrical resistance than the second fixed portions, said first free portions being joined by the bight of said element, such that upon passage of an overcurrent through said bimetallic element it bends primarily in the first free portions, whereby said movable contact arm is released;

an actuating handle connected by linkage means to said contact arm for resetting the breaker after tripping;

wherein said linkage means includes a handle link and an escapement rocking arm, said handle link being pivotally connected at one end to said actuating handle and at its other end to said escapement locking arm, said handle link comprising plural cam posts for sliding in recesses formed in said casing for controlling motion of said handle link.

15. The breaker of claim 14, wherein said handle link is connected to said actuating handle and to said escapement locking arm by pivot pins, said pivot pins being generally concentric with said cam posts.

16. The breaker of claim 15 wherein said escapement locking arm is adapted to urge said contact arm carrying said movable contact the fixed contact upon a user exerting force on said actuating handle.

17. The breaker of claim 16, wherein said escapement locking arm has two ends, is pivotally connected to said handle ink at a point intermediate its ends, and comprises a bearing surface at one end for bearing against said movable contact arm and a locking surface at its other end adapted to be latched in a contacts closed position by said bimetallic element.

18. The breaker of claim 17 wherein said bimetallic element has a latching lip formed thereon for abutting against and latching said locking surface of said escapement locking arm.

19. A thermal circuit breaker comprising:

a casing;

line and load terminals mounted in said casing;

a fixed contact mounted in said casing, and connected to one of said terminals;

a contact arm having a movable contact mounted thereon;

an escapement locking arm adapted to control the motion of said contact arm; and a bimetallic element electrically connected between the other end of said terminals and said contact arm, and comprising means for latching said locking arm in an on position in which said movable contact abuts said fixed contact, said latching means being in communication with said escapement locking arm, wherein said bimetallic element is generally of U-shape, comprising two legs joined by a bight portion;

wherein said bimetallic element is formed from a sheet of laminated bimetallic material of uniform thickness, such that the legs of the U lie in the plane of the sheet;

wherein the legs of the U comprise first fixed terminal portions and second free portions, said second free portions being connected by said bight portion, the first fixed portions of the legs being wider and of lesser electrical resistivity than the second free portions, so that the free portions of the legs and the bight of the U bend out of the plane of said sheet when an overcurrent passes through said element; and wherein the relative orientation of the bimetallic material of the first fixed terminal portions of the legs of said element is reversed with respect to its orientation in the remaining portions of said element, to compensate said element against variation in ambient temperature.

20. The breaker of claim 19, wherein said breaker further comprises handle means and handle link means connecting said handle means to said escapement locking arm.

21. The breaker of claim 20, wherein said handle link means comprises first and second pivot means for pivoted connection of said handle link means to said handle and to said escapement locking arm, and first and second cam posts generally concentric with said first and second pivot means and sliding within first and second recesses in said casing.

22. The breaker of claim 21, wherein said contact arm comprises a strip of resilient material, one end of which is mounted in said casing and the other end of which carries said movable contact, said escapement locking arm comprising a bearing surface adapted to bear against said movable contact arm, to urge said movable contact against said fixed contact, against spring bias exerted by said contact arm, when said breaker is in the contacts closed position.

23. The breaker of claim 22, wherein said first recess comprises a locking pocket into which said first cam post is urged by the bias exerted by said movable contact arm when said breaker is in the contacts closed position, said bias being transmitted to said handle link means by said escapement locking means.

24. The breaker of claim 19, wherein said bimetallic element comprises a latching lip for bearing against a locking surface on said escapement locking arm, such that the escapement locking arm urges said movable contact into engagement with said fixed contact, when said breaker is in the contacts closed position.

25. The breaker of claim 24, wherein when said element bends upon passage of an overcurrent therethrough said latching lip moves out of engagement with said locking surface, releasing said escapement locking arm.

26. The breaker of claim 25, wherein said contact arm comprises a strip of resilient material and said escapement locking arm engages said contact arm to bias said movable contact into engagement with said fixed contact when said breaker is in the contacts closed position.

27. The breaker of claim 24, wherein said latching lip comprises a smooth surface for bearing against said locking surface of said escapement locking arm.

28. A circuit breaker, comprising:

a casing;

line and load terminals;

a contact arm;

fixed and movable contacts, said fixed contact being mounted in said casing and connected to one of said terminals and said movable contact being carried by said contact arm;

a bimetallic control element, adapted for latching said contact arm in a contacts closed position such that said movable contact abuts said fixed contact, said control element being electrically coupled between the other of said terminals and said movable contacts; and an escapement locking arm, said escapement locking arm having first and second ends and comprising a bearing surface at one end for bearing against said contact arm to urge said movable contact against said fixed contact and a locking surface at its other end adapted to be engaged and latched in a contacts closed position by said bimetallic element when said breaker is in a contacts closed position; and an actuating handle connected by linkage means to said escapement locking arm for resetting the breaker after tripping;

wherein said linkage means includes a handle link, said handle link being pivotally connected at one end to said actuating handle and the other end to said escapement locking arm, said handle link comprising plural cam posts sliding in recesses formed in said casing for controlling motion of said handle link.

29. The breaker of claim 28, wherein said handle link is connected to said actuating handle and to said escapement locking arm by pivot pins, said pivot pins being generally concentric with said cam posts.

30. The breaker of claim 29, wherein said handle link is pivotably connected to said escapement locking arm at a point intermediate the ends of the escapement locking arm.

31. The breaker of claim 30, wherein said escapement locking arm is adapted to urge said contact arm carrying said movable contact toward the fixed contact upon a user exerting force on said actuating handle.

32. The breaker of claim 31, wherein said bimetallic element comprises a latching lip for bearing against a locking surface on said escapement locking arm, urging said movable contact into said fixed contact, when said breaker is in the contacts closed position.

33. The breaker of claim 32, wherein said element bends upon passage of an overcurrent therethrough to move said latching lip out of engagement with said locking surface, releasing said escapement locking arm.

34. The breaker of claim 33, wherein said contact arm comprises a strip of resilient material and said escapement locking arm engages said contact arm to bias said movable contact into engagement with said fixed contact when said breaker is in the contacts closed position.

35. The breaker of claim 34 wherein said latching lip comprises a smooth surface for bearing against said locking surface of said escapement locking arm.

36. A circuit breaker, comprising:

a casing;

line and load terminals;

a contact arm;

fixed and movable contacts, said fixed contact being mounted in said casing and connected to one of said terminals and said movable contact being carried by said contact arm;

a bimetallic control element, adapted for latching said contact arm in a contacts closed position such that said movable contact abuts said fixed contact, said control element being electrically coupled between the other of said terminals and said movable contacts; and an escapement locking arm, said escapement locking arm having first and second ends and comprising a bearing surface at one end for bearing against said contact arm to urge said movable contact against said fixed contact and a locking surface at its other end adapted to be engaged and latched in a contacts closed position by said bimetallic element when said breaker is in a contacts closed position;

wherein said bimetallic control element is generally of U-shape, comprising two legs joined by a bight portion, said legs defining first free portions joined by the bight of said U and second fixed portions, said first free portions being of substantially greater electrical resistance than the second fixed portions of each of the legs, such that upon passage of an overcurrent through said bimetallic element it bends primarily in said first free portions, whereby said escapements locking arm is released.

37. The breaker of claim 36, wherein said bight portion and said second fixed portions of the legs of said bimetallic control element are disposed in a triangular configuration and lie in a plane.

38. As an article of manufacture, a thermostatic element formed of a sheet of biemtallic material of uniform thickness, said element being formed in a U configuration, comprising two legs joined by a bight, the legs and bight of the U lying in the plane of the sheet of material, a first portion of each leg of said U being wider than a second portion of each leg of said U, said first portions having correspondingly greater electrical conductivity then said second portions, the orientation of the two metals in said first portions of the legs of the U being reversed relative to their orientation in all other portions of said element such that when the first portions of the legs of the U are confined and an electric current is passed through said element, the second portions of the legs tend to bend to a greater degree than said first portions, and whereby ambient temperature compensation is effectively provided for said element.

39. A thermal circuit breaker, comprising:

a casing;

line and load terminals mounted in said casing;

fixed and movable contacts connected to said load and line terminals;

a contact arm carrying said movable contact for movement between contacts open and contacts closed positions; and a temperature compensated bimetallic element electrically coupled between said movable contact and one of said terminals, and adapted to control the movement of said movable contact arm in response to an electrical current flowing through said element, wherein the control provided by said element is substantially unaffected by variations in ambient temperature;

wherein said bimetallic element is formed of a generally planar sheet of laminated bimetallic material, and is generally of U-shape comprising two legs and a bight portion connecting said legs;

wherein said legs of said U-shaped bimetallic element comprise terminal portions by which said element is connected to said movable contact arm and to said one of said terminals, said terminal portions being of differing transverse dimensions than are their remaining portions, to provide differential deflection of said terminal and remaining portions of said legs upon passage of an electrical current through said element.

* * * * *